US005758526A

United States Patent [19]

Gorokhovsky

[11] Patent Number: 5,758,526

[45] Date of Patent: Jun. 2, 1998

[54] LOCK

[76] Inventor: Mark Gorokhovsky, 490-33rd Ave. #206, San Francisco, Calif. 94121

[21] Appl. No.: 519,716

[22] Filed: Aug. 28, 1995

[51] Int. Cl.[6] ..... E05B 9/04

[52] U.S. Cl. ..... 70/375; 70/367; 70/419

[58] Field of Search ..... 70/367–369, 375, 70/423, 491–493, 419–421, 427, 453–455

[56] References Cited

U.S. PATENT DOCUMENTS

| | | | |
|---|---|---|---|
| 1,560,868 | 11/1925 | Shinn | 70/455 |
| 2,783,636 | 3/1957 | Scott | 70/420 X |
| 2,906,112 | 9/1959 | Vahlstrom | 70/455 |
| 3,813,906 | 6/1974 | Kerr | 70/419 X |
| 3,971,242 | 7/1976 | Mikos | 70/491 X |
| 3,992,907 | 11/1976 | Pilvet | 70/491 X |
| 4,056,955 | 11/1977 | Glass | 70/421 X |
| 4,099,396 | 7/1978 | Kerr | 70/419 X |
| 4,112,820 | 9/1978 | Conger et al. | 70/421 X |
| 4,213,315 | 7/1980 | Lewis | 70/421 X |
| 4,759,204 | 7/1988 | Neyret | 70/367 X |
| 4,966,018 | 10/1990 | Hauber | 70/367 X |
| 5,024,072 | 6/1991 | Lee | 70/491 |
| 5,148,690 | 9/1992 | Wang | 70/419 X |
| 5,163,310 | 11/1992 | Wang | 70/491 |
| 5,263,348 | 11/1993 | Wittwer | 70/422 X |
| 5,475,997 | 12/1995 | Chung | 70/419 X |
| 5,505,065 | 4/1996 | Hesse | 70/367 X |

FOREIGN PATENT DOCUMENTS

| | | | |
|---|---|---|---|
| 2343878 | 11/1977 | France | 70/419 |

*Primary Examiner*—Suzanne Dino Barrett
*Attorney, Agent, or Firm*—Ilya Zborovsky

[57] ABSTRACT

A lock has a rotatable member (24), a latch member (22) operatively connected to the rotatable member for movement between locked and unlocked positions when the rotatable member is turned, a key stop (38) having an end facing toward an exposed end of a casing (10) that defines, together with the end of the rotatable member facing toward the exposed end of the casing a dead-end wall. Key stop (38)is mounted for axial reciprocation in, and for combined rotation with rotatable member (24) and has in the end facing toward the exposed end at least one code socket (46, 48) offset with respect to the axis of rotation of the rotatable member. The lock also has a rotatable spring-loaded block (54) mounted between the exposed end of the casing and the end of the key stop. The block is held in the casing against axial movement and has a substantially diametrical key slot (72) angularly offset with respect to the code socket. The key stop is axially pressed against the rotatable block by a spring (42).

5 Claims, 6 Drawing Sheets

LOCK

FIELD OF THE INVENTION

The invention relates to a lock, and more specifically, it deals with a lock having code elements engageable with respective axial code elements of a key.

BACKGROUND OF THE INVENTION

A prior art lock (U.S. Pat. No. 3,903,720 to Frank J. Scherbing) has a rotatable member mounted in a casing and operatively connected to a latch member for moving it between unlocked and locked positions when turned by a key. The lock has a combination of code pins and protective pins and a key guide mounted in an offset position with respect to the axis of rotation of the rotatable member. It is very difficult to open this prior art lock because of a very sophisticated and intricate system of protection. One of the major disadvantages of this prior art lock is its very sophisticated construction. The lock has a large number of parts and requires very high accuracy in the manufacture. Another disadvantage of the lock is the possibility of damage to the lock when an attempt is made to tamper with it, because a tiny object can be inserted into a very narrow eccentric slot between the key guide and spindle or rotatable member. Such a tiny object can be broken and left in the eccentric slot so that the key will not be able to open the lock.

SUMMARY OF THE INVENTION

It is the primary object of the invention to provide a lock of the above type which would be very simple in construction while offering at least the same measure of security.

Another object of the invention is to provide a lock of the above type that consists of a small number of parts manufactured to normal tolerances and that is simple to make and assemble.

Finally, it is an object of the invention to provide a lock of the above type that is reliably protected against any mechanical damage when an attempt is made to tamper with the lock.

With these and other objects in view, there is provided a lock having a hollow casing, a rotatable member mounted in the casing, a latch member operatively connected to the rotatable member for movement between locked and unlocked positions when the rotatable member is turned, a key stop having an end facing toward an exposed end of the casing that defines a dead-end wall of the casing together with the rotatable member, the key stop being mounted for reciprocation in, and for combined rotation with, the rotatable member and having in an end, facing toward the exposed end of the casing, at least one code socket offset with respect to the axis of rotation of the rotatable member, a rotatable spring-loaded block mounted between the exposed end of the casing and the end of the key stop, the block being held in the casing against axial movement and having a substantially diametrical key slot angularly offset with respect to the code socket and a spring between the key stop and rotatable member.

With this construction of the lock, the keyhole slot of the block is always offset with respect to the code sockets of the key stop. It is very difficult, if possible, to insert a tiny device into the lock because the block has to be turned first, and another tool has to be inserted to turn the block. It will be understood that since the code sockets are provided in the key stop, no other individual parts functioning as code elements are required. It will be also apparent that even if a tiny tampering tool is inserted into the lock, it cannot cause any damage to the lock. The spring acting upon the key stop facilitates normal use of the lock. At the same time, the provision of this spring hinders tampering because the key stop is always pressed against the rotatable block, and it is difficult to turn the key stop and/or the block by using tiny tampering tools.

Making the end of the key stop convex provides another safety feature of the lock as it is practically impossible to locate code sockets.

At least one spring-loaded shutter may be provided in the block between the exposed end of the casing and the end of the key stop to make the key sockets invisible and to form an additional barrier against tampering.

These and other objects and advantages of the invention will become apparent from the following detailed description of its embodiments and operation.

DESCRIPTION OF PREFERRED EMBODIMENTS

Figure 1:
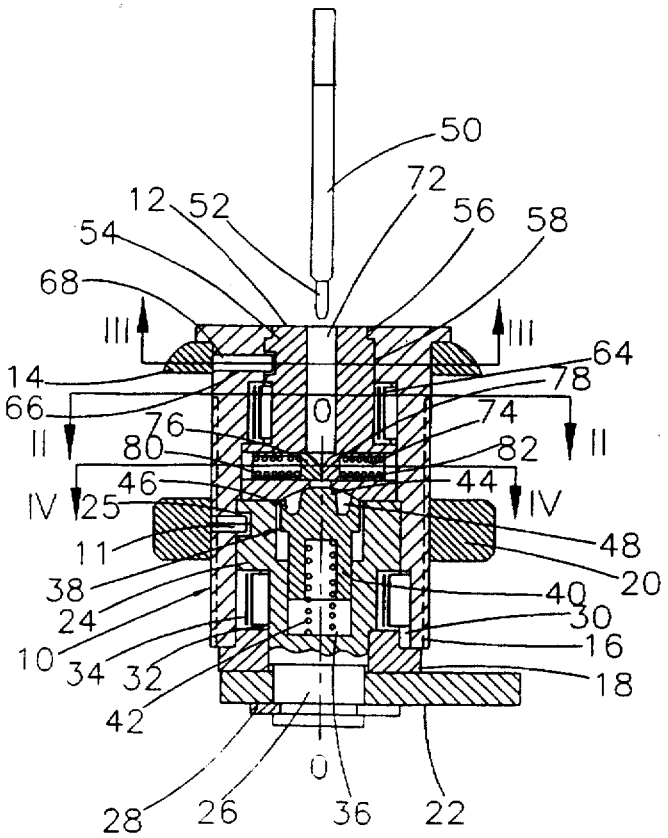
FIG.1 is a general sectional view of a lock according to the invention.
Figure 7:
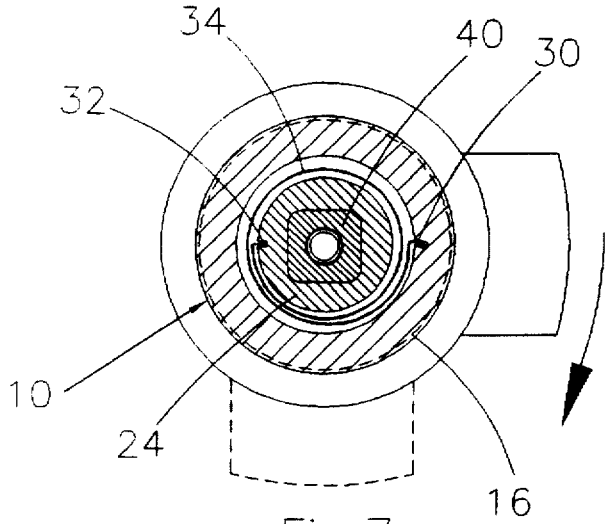
FIG. 7 is a sectional view taken along line VII—VII in FIG. 6.
Figure 8:
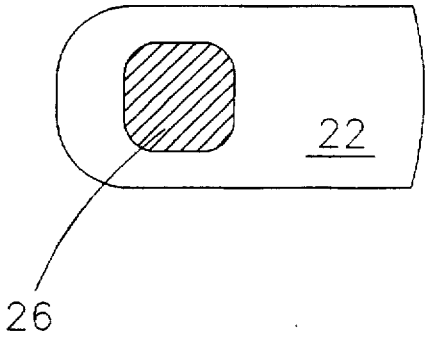
FIG. 8 is a sectional view taken along line VIII—VIII in FIG. 6.

With reference to FIG. 1, a lock according to the invention has a casing 10 having an exposed end 12 that is to be located outside a device protected by the lock. The casing has a flange 14, a thread 16, an end plate 18, and a nut 20 that is designed for fastening the lock in a bore of a device protected by the lock in a known per se manner. The lock has a latch member 22 and a rotatable member 24. Rotatable member 24 is mounted in casing 10 for a limited rotation. Rotation of rotatable member 24 is limited by a pin 11 installed in casing 10 and received in a peripheral groove 25 (FIG. 1). Peripheral groove 25 preferably extends over one quarter of the circle. The length of peripheral groove 25 chosen as mentioned above allows latch member 22 to be moved between locked and unlocked positions. Latch member 22 is connected to the rotatable member for movement between locked and unlocked positions. For that purpose, latch member 22 is mounted on a square-shaped journal 26 of rotatable member 24 and is held by a lock ring 28 (e. g., an E-ring) (FIG. 8). Latch member 22 is shown in FIG. 1 in the locked position. Casing 10 has an inner longitudinal groove 30 and rotatable member 24 has an outer longitudinal groove 32 (FIGS. 1 and 7), and a torsion spring 34 has its ends received in these grooves. Spring 34 always holds latch member 22 in the locked position.

Rotatable member 24 has one end facing toward exposed end 12 of casing 10 and a blind hole 36 in the opposite end, and a key stop 38 is mounted in hole 36 for axial reciprocation and for rotation with the rotatable member. For that purpose hole 36 and a shank 40 of key stop 38 are of a non-round configuration, e.g., square as shown in FIG. 7. A spring 42 is mounted between the bottom of blind hole 36 and key stop 38 and presses key stop 38 in the direction toward exposed end 12 of casing 10. Key stop 38 has an end 44 facing toward exposed end 12 of casing 10 and defining a dead-end wall of casing 10 together with the end of rotatable member 24 facing toward the exposed end of the casing. Key stop 38 also has code sockets 46, 48 in the form of axial recesses of depressions in end 44 engageable with a key 50 having respective prongs 52. Code sockets 46, 48 are offset with respect to axis of rotation O—O of rotatable member 24. It is understood that key stop 38 can have at least one code socket 48 offset with respect to axis O—O. End 44 of key stop 38 can have a convex, e.g., spherical face as shown in FIG. 1. It can be seen that rotation of key stop 38 counterclockwise results in rotation of rotatable member 24 and latch member 22 to move the latter to the unlocked position and to arm spring 34 as described below (FIGS. 7, 8).

Figure 2:
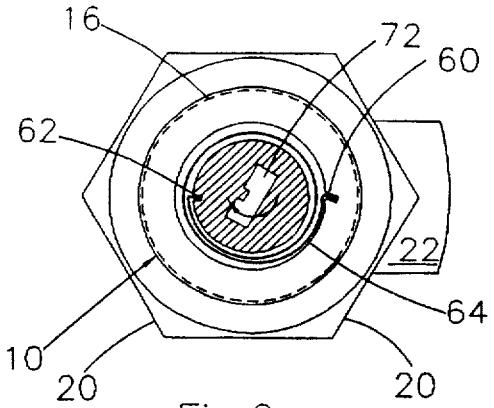
FIG. 2 is a sectional view taken along line II—II in FIG. 1.
Figure 3:
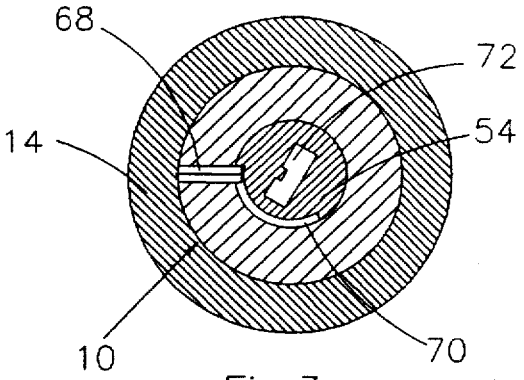
FIG. 3 is a sectional view taken along line III—III in FIG. 1.

The lock according to the invention has a rotatable block 54 that is mounted in casing 10 for rotation and is held against axial movement. For that purpose, casing 10 has, at its exposed end 12, an internal projection 56, and block 54 has an enlarged diameter portion 58 defining a step bearing against projection 56. Casing 10 has a longitudinal groove 60 on the side of its exposed end 12, and block 54 has a longitudinal slot 62, and a torsion spring 64 has its end received in slots 60 and 62, respectively. Casing 10 has a radial bore 66 in which a stop pin 68 is received to protrude into the interior of casing 10. Block 54 has a groove 70 in a part of its periphery (FIG. 3), and the protruding end of pin 68 is received in this groove. Groove 70 extends over a part of a circle greater than one quarter of a circle. The other end of pin 68 is covered by flange 14 or is otherwise fixed. Block 54 has a through slot 72 defining a keyhole for key 50. To assemble the lock, rotatable block 54 is inserted all the way into casing 10 until it bears against projection 56. Spring 64 is then slid into the casing so that its ends be received in grooves 60 and 62 of casing 10 and block 54, respectively. Block 54 is then turned at its slot 72 to arm spring 64, and stop pin 68 is inserted into bore 68 to protrude into groove 70 of block 54 (FIGS. 1, 3). The angle through which block 54 is to be turned to arm spring 64 depends on position of code sockets 46, 48 of key stop 38. Each key stop has an individual pattern of code sockets to define security of the lock, and the angular offset of slot 72 of the keyhole with respect to code socket(s) 46, 48 will be different for each lock. It will be understood that this angular offset has to be such that block 54 could fully cover code sockets 46, 48. With this construction, position of the code sockets can only be seen when block 54 is turned. Bearing in mind that slot 72 should not be too wide for normal use of the lock, it is very problematic for one to see anything in the interior of the lock if any tool is inserted into slot 72 to turn block 54. Nut 20 is then run down threads 16 of casing 10, and rotatable member 24 with key stop 38 and spring 42 received in its interior 36 are inserted into casing 10 until end 44 of key stop 38 bears against block 54. The ends of torsion spring 34 are then inserted into grooves 30 and 32 of casing 10 and rotatable member 24, respectively, and end plate 18 is then installed in the end of casing 10 opposite to its exposed end 12 to compress spring 42, press key stop 38 against rotatable block 54 and hold the parts in the position shown in FIG. 1. Latch member 22 is then installed on journal 26 of rotatable member 24, and lock ring 28 is installed in a groove of journal 26 to hold in position both latch member 22 and end plate 18. It will be understood that after the lock has been put together as described above, code sockets 46, 48 are fully covered by block 54 held in this position by torsion spring 64, latch member 22 is in its locked position, and key stop 38 has its spherical end 44 pressed against rotatable block 54 under the action of spring 42. Latch member 22 can be held by any other appropriate known means.

Figure 4:
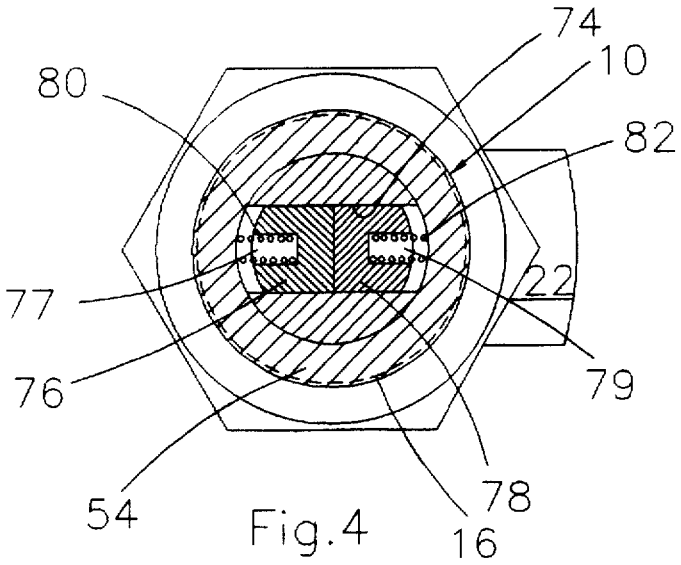
FIG. 4 is a sectional view taken along line IV—IV in FIG. 1.

Rotatable block 54 has a diametrical hole 74 (FIGS.1 and 4), and a pair of shutters 76, 78 are slidingly received in this hole 74 and have chamfers facing toward exposed end 12 of casing 10 as shown in FIG. 1. Shutters 76, 78 have bores 77, 79 (FIG. 4), and preloaded springs 80, 82 are received in these bores. Shutters 76, 78 are inserted into hole 74 before putting block 54 into casing 10. Springs 80, 82 are then inserted into bores 77, 79 and compressed before the insertion of block 54 into casing 10. Shutters 76, 78 provide an additional protection against tampering and obstruct code sockets 46, 48 of key stop 38. Moreover, the shutters demand an additional force to be applied by a tampering tool to clear the way for any other tampering device that might be inserted through slot 72 of block 54. It will be apparent to those skilled in the art that one shutter can also be mounted in the rotatable block to perform the same function.

Figure 5:
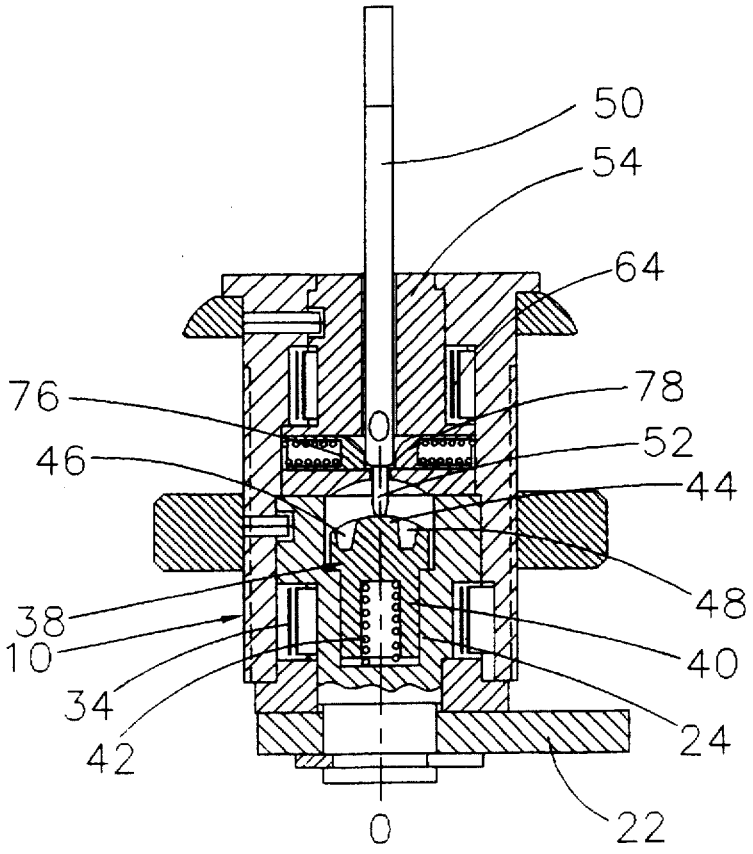
FIG. 5 is shows the lock of FIG.1 with an inserted key.
Figure 6:
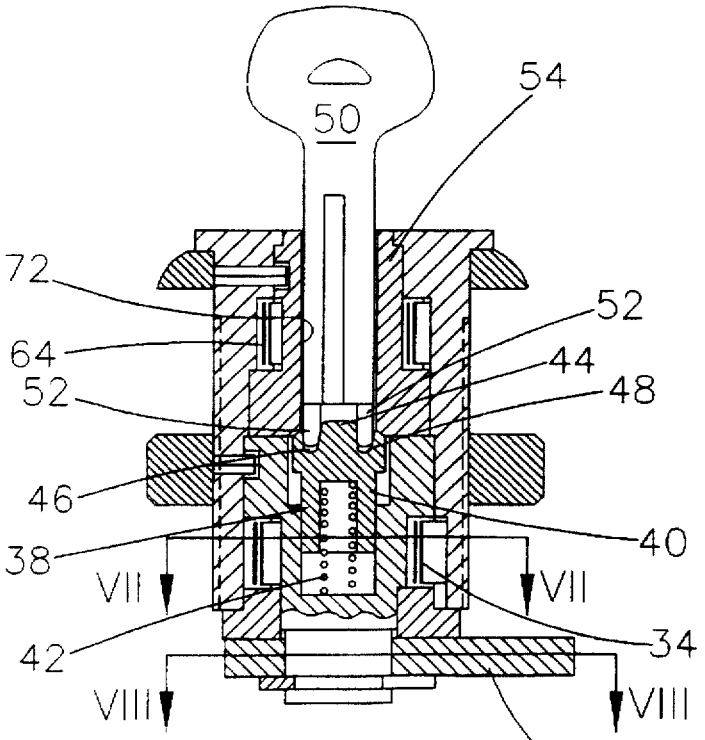
FIG. 6 is shows the lock of FIG.1 before turning the key to unlock.

For unlocking the lock, key 50 is inserted into keyhole slot 72 (FIG. 5) to move apart shutters 76, 78 and compress their springs 80, 82 and pushed all the way down (in the drawing) to press down key stop 38 and compress spring 42. When key stop 38 is thus pressed down, its spherical end 44 defines an ideal sliding surface for prongs 52 of the key, and key 50 can be turned counterclockwise until its prongs 52 are in registry with code sockets 46, 48. At this moment spring 42 expands and will push key stop 38 back until prongs 52 are received in code sockets 46, 48. This position of the lock parts is shown in FIG. 6. When key 50 was turned to bring its prongs 52 in registry with code sockets 46, 48 of key stop 38, block 54 was also turned, and torsion spring 34 is armed. Key 50 can now be turned counterclockwise to turn key stop 38 and rotatable member 24. When rotatable member 24 is turned, latch member 22 is also turned to unlocked position (shown with dotted lines in FIGS. 7, 4), and torsion spring 34 is armed. The device that is protected by the lock (as a desk drawer or a door, etc., such as in a vending machine, tool box) can now be opened. As soon as the key is released, latch member 22 is moved to its original locked position by torsion spring 34, and block 54 is turned by its torsion spring 64 back to the initial position. This means that when key 50 is removed from the lock, slot 72 of block 54 is again angularly offset with respect to code sockets 46, 48 of key stop 38, and latch member 22 is in its locked position. To lock again, key 50 has to be inserted and manipulated in the reversed order to put latch member in the unlocked position. When a door or drawer is closed, and the key is released, latch member 22 will be turned back to the locked position by torsion spring 34. It will be apparent to those skilled in the art that torsion spring 34 is optional, and its use is determined by a specific application of the lock. If the latch member is used in combination with a respective spring-loaded member of the device being protected, or the latch member is engageable with a mating slot with a tight fit, spring 34 can be dispensed with.

The embodiment of the lock described above can be used for protecting drawers, small metal doors (e. g., in electrical cabinets, vending machines, tool boxes, etc.).

Another embodiment of the lock according to the invention shown in FIGS. 9 through 18 can be used for various security devices such as antitheft locking devices for vehicles, doors and the like. It differs from what was described above by movement of the latch member that reciprocates.

Figure 9:
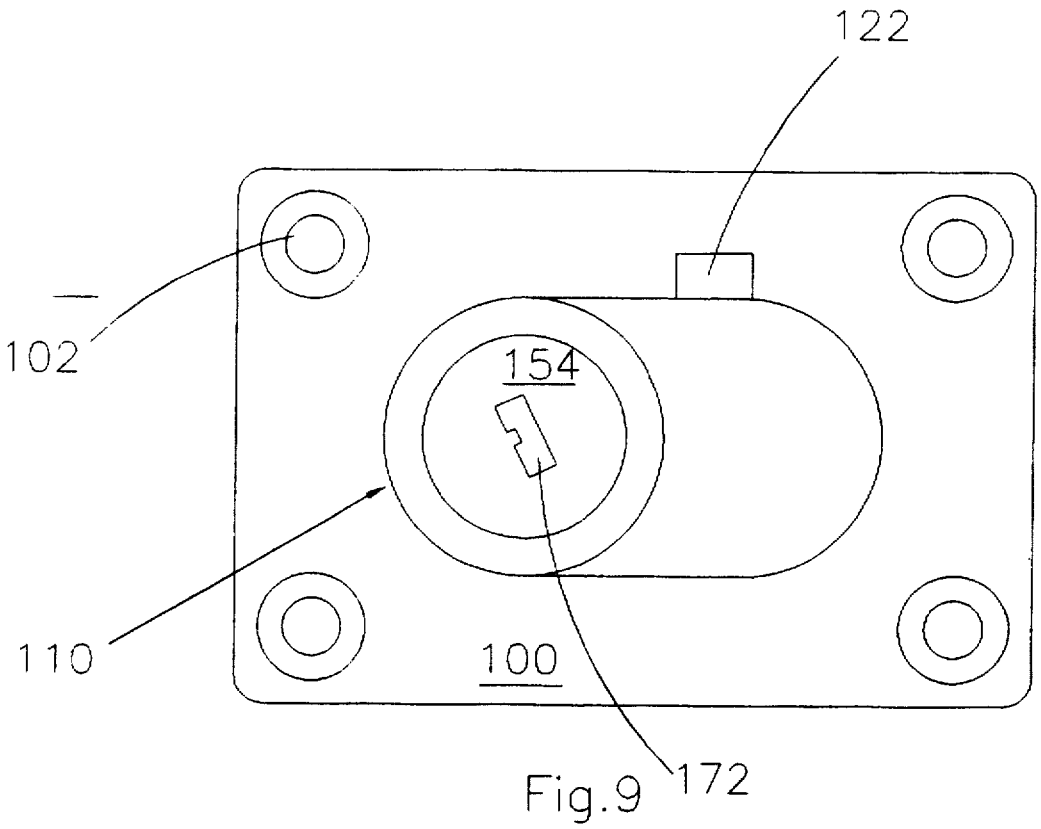
FIG. 9 is another embodiment of a lock according to the invention, a top view.
Figure 10:
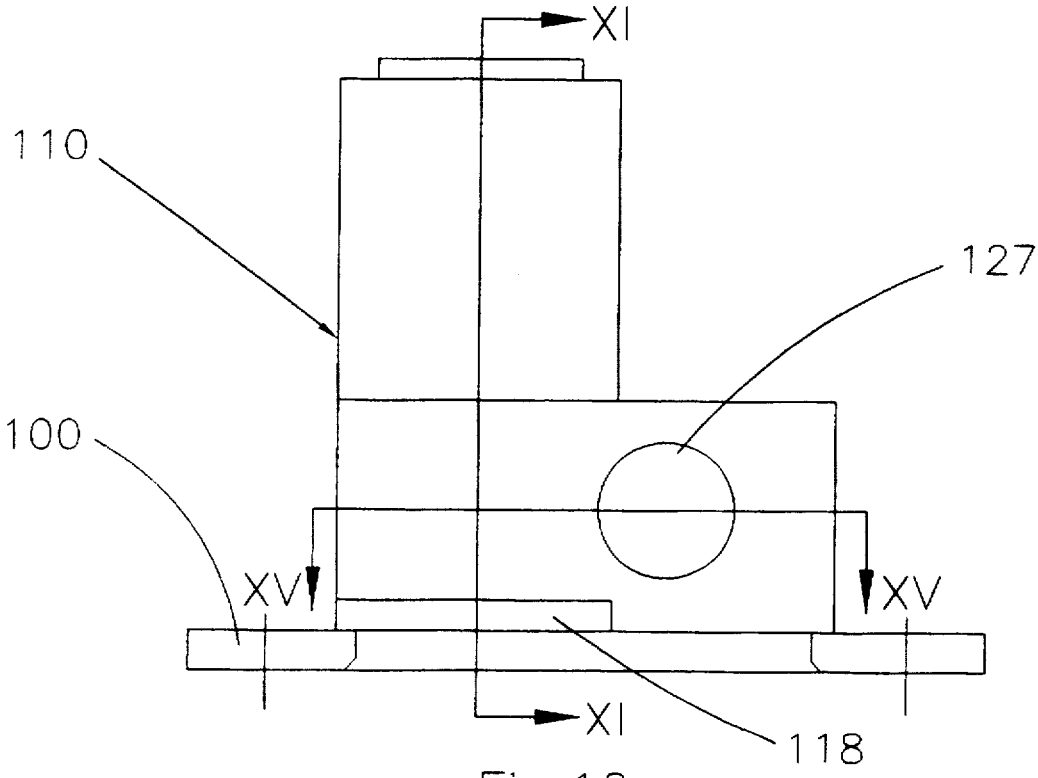
FIG. 10 is a front view of the lock of FIG. 9.
Figure 12:
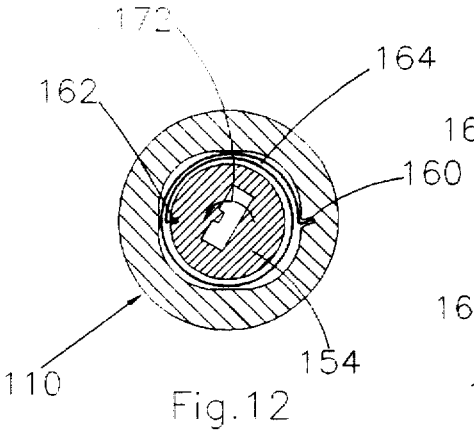
FIG. 12 is a sectional view taken along line XII—XII in FIG. 11.
Figure 13:
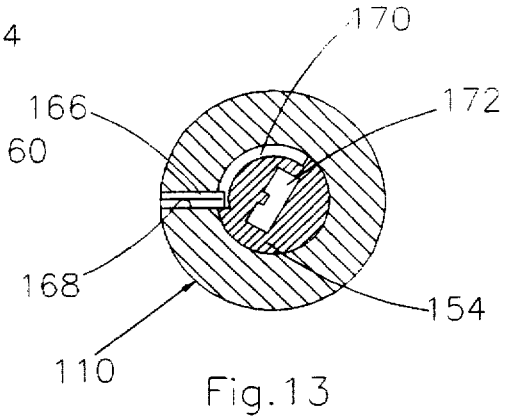
FIG. 13 is a sectional view taken along line XIII—XIII in FIG. 11.

With reference to FIGS. 9, 10, a lock has a base plate 100 with holes 102 for fastening, and a casing 110 made fast to the base plate. Base plate 100 can be dispensed with in certain applications if the lock is built in a device being protected.

Figure 11:
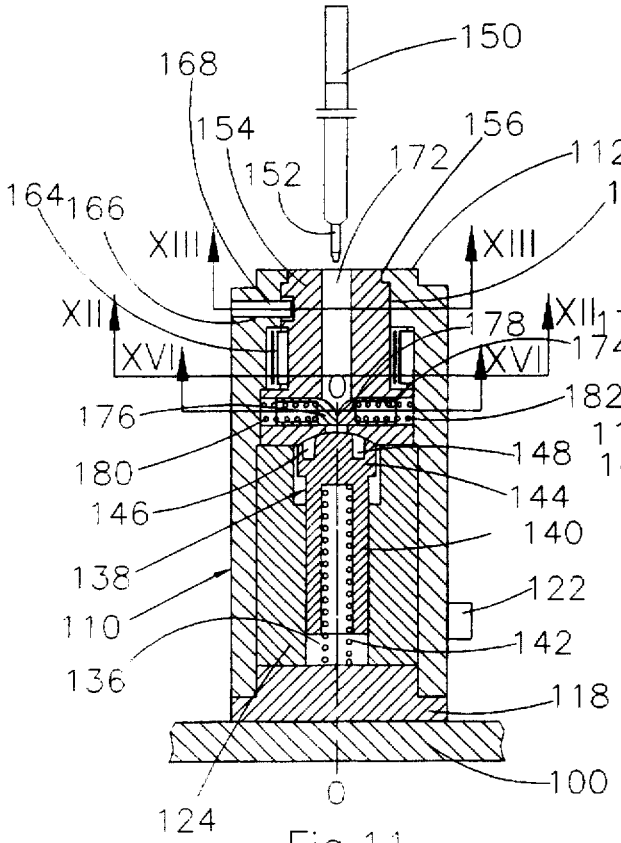
FIG. 11 is a sectional view taken along line XI—XI in FIG. 10.

As shown in FIG. 11, a rotatable member 124 has an end facing toward an exposed end 112 of casing 110 and a hole 136 of a non-round cross-section, and a key-stop 138 having a non-round shank 140 is received in this hole. Spring 142 urges key stop 138 in the direction toward exposed end 112 of casing 110. Key stop 138 has its end 144 defining with the end of rotatable member 124 a dead end wall of casing 110 facing toward exposed end 112 of casing 110. Code sockets 146, 148 offset with respect to axis of rotation O—O of rotatable member 124 are provided in end 144 of key stop 138.

A rotatable block 154 is mounted in casing 110 on the side of its exposed end 112. Casing 110 has an inner projection 156, and rotatable block 154 has an enlarged portion 158 defining a step bearing against inner projection 156 thus holding rotatable block 154 against axial movement. Grooves 160, 162 are provided in casing 110 and rotatable member 124, respectively (FIG. 12), and a torsion spring 164 has its ends received in these grooves. A radial hole 166 (FIGS. 11, 13) is made in casing 110, and a stop pin 168 is mounted in this hole to protrude into the interior of casing 110. A groove 170 is cut in a part of the periphery of rotatable block 154 (FIG. 13), and the protruding end of pin 168 is received in this groove to limit rotation of block 154 within 90°. Rotatable block 154 has a through slot 172 defining a keyhole for insertion of key 150. Rotatable block 154 can be rotated when key 150 is inserted into slot 172 to arm spring 164, and this rotation is limited by stop pin 108.

Rotatable block 154 has a diametrical hole 174 (FIGS. 11, 16), and shutters 176 and 178 are mounted in this hole and have chamfers on the sides facing toward exposed end 112 of casing 110 as shown in FIG. 11. Springs 180 and 182 are mounted in the shutters and are preloaded during assembly of the lock.

Figure 18:
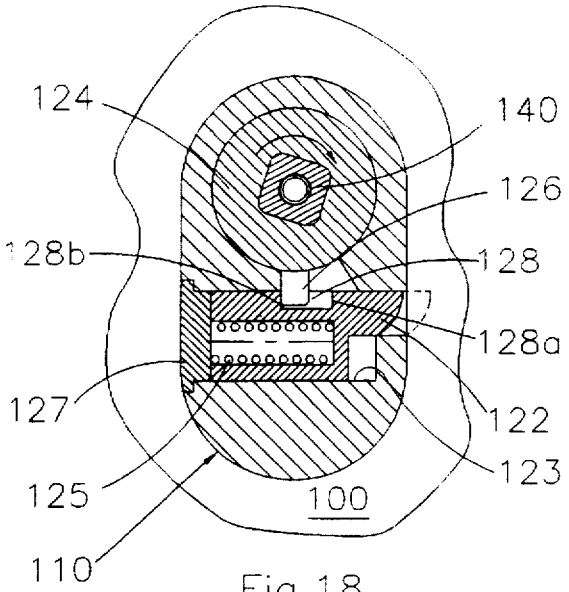
FIG. 18 is a sectional view similar to FIG. 15 showing the parts in the unlocked position.
Figure 17:
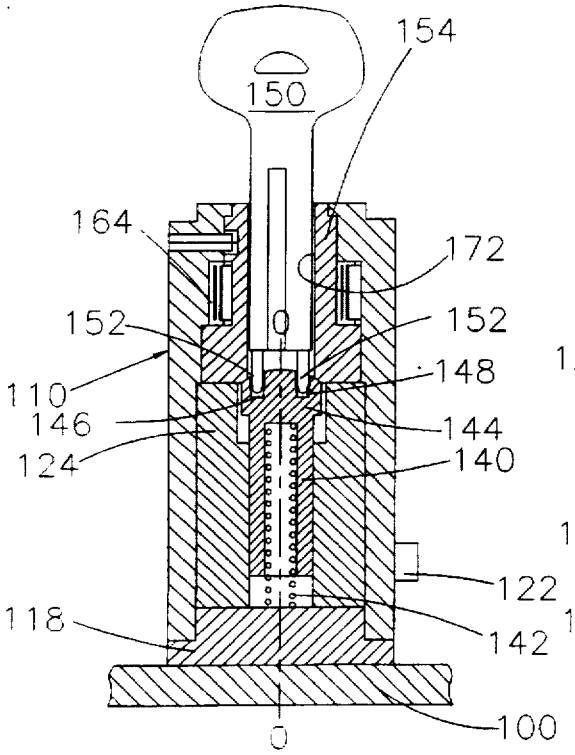
FIG. 17 is the lock of FIG. 11 before turning the key to unlock.
Figure 15:
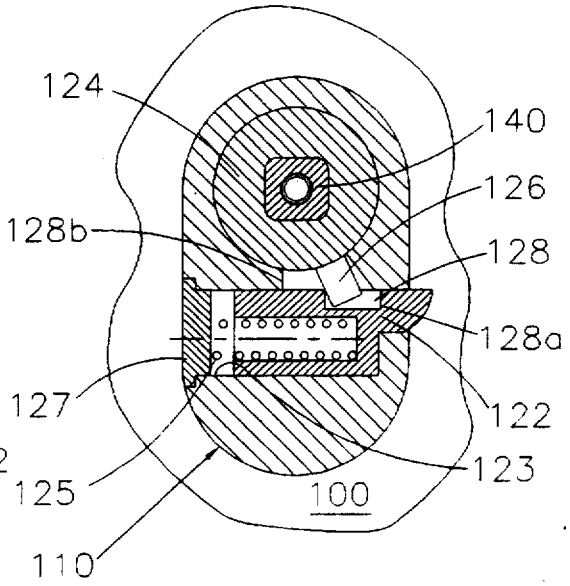
FIG. 15 is a sectional view taken along line XV—XV in FIG. 10 (turned) showing the position of parts with the key inserted as in FIG. 14.

A latch member 122 is mounted for reciprocation in a slot 123 of the casing (FIGS. 15, 18). The latch member is biased by a spring 125 to the locked position. Spring 125 is held compressed by a plug 127. Latch member has a groove 128 in which a drive member 126 is received. Drive member 126 is made fast with rotatable member 124. For the rest, this embodiment of the lock is constructed as the embodiment described above. If latch member 122 is pushed to the left in FIG. 15, spring 125 will be compressed after closure of, e. g., a door (not shown), and the spring will return latch 122 to the locked position.

When the lock is assembled, shutters 176 and 178 with their respective springs 180 and 182 are first inserted into diametrical hole 174 of rotatable block 154, one end of spring 164 is inserted into groove 162 of block 154, and the rotatable block is then inserted all the way into casing 110 until its step bears against projection 156 and the other end of spring 164 is received in groove 160 of casing 110. Springs 180 and 182 are compressed, and shutters 176 and 178 are in the position shown in FIG. 11. Rotatable block 154 is then turned to a certain position in which its slot 172 will be in registry with code sockets 146, 148 of key stop 138, and pin 168 is then inserted into hole 166 of casing 110 to be received in groove 170 of block 154 and is secured in any appropriate known manner. Latch member 122 (FIG. 15) is inserted into slot 123 of casing 110. Key stop 138 is inserted into hole 136 of rotatable member 124, and rotatable member 124 is inserted into casing 110 so that end 144 of key stop 138 bears against rotatable block 154 and drive member 126 of rotatable member 124 is received in groove 128 of latch member 122. Spring 125 is inserted into latch member 122 and is compressed and fastened by plug 127 fixed in the casing in any appropriate known manner. End plate 118 (that may be part of base plate 100) is then put into the end of casing 110 opposite to its exposed end 112 to slightly compress spring 142 and is fixed in position. As shown in FIG. 15, rotatable member 124 is turned by spring 164 to the position shown, and latch 122 is in the protruding or locked position under the action of its spring 125. Thus the lock is always in the locked position, and latch 122 can only be held in the unlocked position either by hand or by key.

Figure 14:
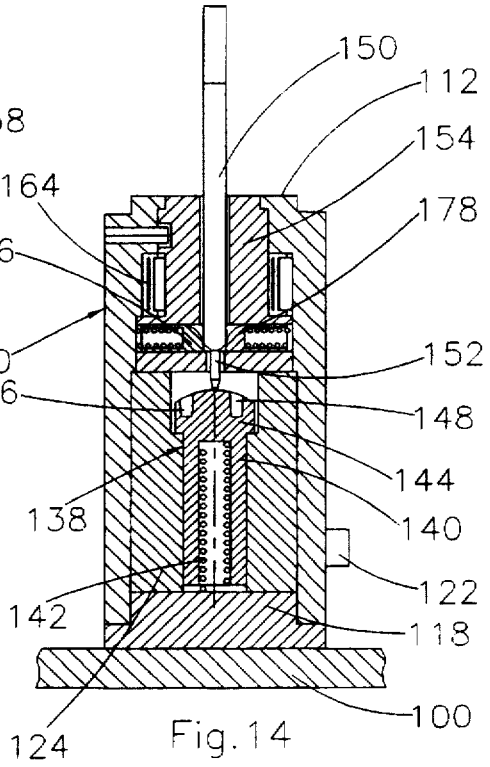
FIG. 14 is the lock of FIG. 11 with a key inserted into the lock.
Figure 16:
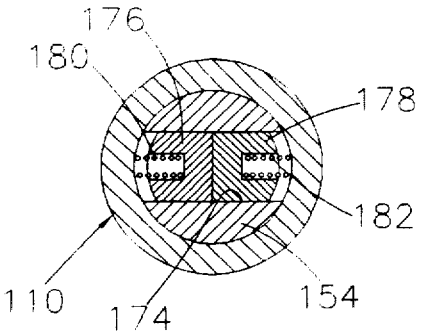
FIG. 16 is a sectional view taken along line XVI—XVI in FIG. 11.

When key 150 is inserted into keyhole slot 172 to move apart shutters 176, 178, it is pushed all the way down in FIG. 14 to move down key stop 138 and to compress spring 142. The key is then turned counterclockwise to arm spring 164 (FIG. 12) until its prongs 152 are in registry with code sockets 146, 148 of key stop 138. The key stop is then moved up by spring 142 so that prongs 152 of key 150 be received in code sockets 146, 148. If the key is now turned clockwise as shown in FIG. 18, drive member 126 of rotatable member 124 is pressed against trailing wall **128*b* of groove 128 of latch member 122 to move the latch member 122 to the unlocked position shown in FIG. 18. When key 150 is turned counterclockwise to locate code sockets 146, 148, torsion spring 164 is armed. If the key is released in the position shown in FIG. 17, armed torsion spring 164 will turn the key and key stop 138 counterclockwise to rotate rotatable member 124 and to move drive member 126 so as to move latch member 122 to the unlocked position. This means that the lock in this embodiment is automatically unlocked with a certain ratio between forces of springs 164 and 125 and the radial distance from trailing wall 128*b* to axis of rotation O—O of rotatable member 124**.

It will be apparent from the above description of preferred embodiments of the invention that the lock according to the invention has a very simple construction, it has a small number of parts and does not require stringent tolerances in manufacture. At the same time, it is very difficult to tamper the lock according to the invention.

I claim:

1. A lock comprising;

a hollow casing having an exposed end;

a rotatable member mounted in said casing and having an end facing toward said exposed end of said casing and an axis of rotation;

a latch member operatively connected to said rotatable member for movement between locked and unlocked positions when said rotatable member is turned on;

a key stop having an end facing toward said exposed end that defines, together with said end of said rotatable member facing toward said exposed end of said casing, a dead-end wall of said casing, said key stop being mounted for axial reciprocation in, and for combined rotation with, said rotatable member and having in said end facing toward said exposed end at least one code socket offset with respect to said axis of rotation;

a rotatable spring-loaded block mounted between said exposed end of said casing and said end of said key stop, said block being held in said casing against axial movement and having a substantially diametrical key slot angularly offset with respect to said at least one code socket;

a spring, said spring axially pressing said key stop against said block, said end of said latch member being convex.

2. The lock of claim 1, wherein said rotatable plug has at least one spring-loaded shutter positioned between said exposed end of said casing and said blind end of said latch member.

3. A lock comprising:

a hollow casing having an exposed end;

a rotatable member mounted for a limited rotation in said casing and having an end facing toward said exposed end of said casing and an axis of rotation;

a latch member operatively connected to said rotatable member for reciprocation in said casing between locked and unlocked positions when said rotatable member is turned;

a key stop having an end facing toward said exposed end that defines, together with said end of said rotatable member facing toward said exposed end of said casing, a dead-end wall of said casing, said key stop being mounted for axial reciprocation in, and for combined rotation with, said rotatable member and having in said end facing toward said exposed end at least one code socket offset with respect to said axis of rotation;

a rotatable spring-loaded block mounted between said exposed end of said casing and said end of said key stop, said block being held in said casing against axial movement and having a substantially diametrical key slot angularly offset with respect to said at least one code socket;

a spring, said spring axially pressing said key stop against said block, said end of said latch member being convex.

4. The lock of claim 3, wherein said rotatable plug has at least one spring-loaded shutter positioned between said exposed end of said casing and said blind end of said latch member.

5. A lock comprising:

a hollow casing having an exposed end;

a rotatable member mounted in said casing and having an end facing toward said exposed end of said casing and an axis of rotation;

a latch member mounted for combined rotation with said rotatable member between locked and unlocked positions when said rotatable member is turned on;

a key stop having an end facing toward said exposed end that defines, together with said end of said rotatable member facing toward said exposed end of said casing, a dead-end wall of said casing, said key stop being mounted for axial reciprocation in, and for combined rotation with, said rotatable member and having and having in said end facing toward said exposed end at least one code socket offset with respect to said axis of rotation;

a rotatable spring-loaded block mounted between said exposed end of said casing and said end of said key stop, said block being held in said casing against axial movement and having a substantially diametrical key slot angularly offset with respect to said at least one code socket;

at least one spring-loaded shutters in said rotatable block positioned between said exposed end of said casing and said end of said key stop defining said dead-end wall;

a spring, said spring axially pressing said key stop against said block, said end of said latch member being convex.

* * * * *